United States Patent [19]

Bullard

[11] 4,185,705

[45] Jan. 29, 1980

[54] WELL PERFORATING TOOL

[76] Inventor: Gerald Bullard, P.O. Box 195, Upton, Wyo. 82730

[21] Appl. No.: 917,269

[22] Filed: Jun. 20, 1978

[51] Int. Cl.[2] ..... E21B 1/06

[52] U.S. Cl. ..... 175/78; 175/94

[58] Field of Search ..... 175/78, 81, 82, 79, 175/94, 61, 73, 77

[56] References Cited

U.S. PATENT DOCUMENTS

| | | | |
|---|---|---|---|
| 2,500,785 | 3/1950 | Arutunoff | 175/78 |
| 2,516,421 | 7/1950 | Robertson | 175/78 |
| 2,539,047 | 1/1951 | Arutunoff | 175/81 X |
| 2,558,452 | 6/1951 | Mennecier | 175/81 X |
| 2,631,821 | 3/1953 | Caldwell | 175/78 |
| 2,644,669 | 7/1953 | Curtis et al. | 175/78 X |
| 2,693,342 | 11/1954 | Lynes | 175/78 |
| 3,528,515 | 9/1970 | Garrison | 175/78 |
| 3,797,576 | 3/1974 | Azalbert et al. | 175/78 X |
| 3,888,319 | 6/1975 | Bourne, Jr. et al. | 175/61 |
| 4,007,797 | 2/1977 | Jeter | 175/81 |
| 4,051,908 | 10/1977 | Driver | 175/78 |

*Primary Examiner*—James A. Leppink
*Assistant Examiner*—Richard E. Favreau
*Attorney, Agent, or Firm*—Bacon & Thomas

[57] ABSTRACT

A well perforating tool (9) for drilling holes in a well casing substantially from and at right angles to a vertical well bore within which the casing is disposed. The tool (9) includes an elongate housing (15) for insertion within the casing and having a detachable boot (13) at one end thereof for centralizing the longitudinal axis of the tool within the casing. Two motors (53,85) are disposed within the housing (15) for rotating a flexible drill shaft (97), and advancing and retracting the flexible drill shaft (97) with respect to the interior wall of the casing. The entire tool is supported by a cable (19) which also includes power supply and signal lines for independently activating the motors (53,85) from an above-ground control station and ascertaining the depth of drill shaft penetration.

10 Claims, 8 Drawing Figures

WELL PERFORATING TOOL

TECHNICAL FIELD OF THE INVENTION

The invention relates to a tool for use in perforating a well casing and associated bore formation materials so that hydrocarbon values can be recovered through the well casing. The tool is capable of reliably and accurately placing any number of perforations along the entire length of the well casing without damaging the well structure.

BACKGROUND OF THE PRIOR ART

A well casing is normally disposed within a vertically oriented well bore and sealed therein by pumping cement into the annular space between the outer surface of the casing and internal wall of the bore. The well casing may be made of metal or synthetic plastic material and can extend for several miles below the ground surface.

In order to maximize the extraction of hydrocarbon values from a well, it is often necessary to provide a series of lateral perforations through the well casing, adjacent casing cement and bore formation material. However, the procedure of accurately positioning a perforating tool in the desired vicinity of the casing to be perforated, and reliably effecting the perforation without damaging the well structure, is often a very critical and difficult task to accomplish, particularly if the perforations are to be placed thousands of feet below ground level.

The prior art has sought to accomplish the accurate and reliable perforating of well casings through the use of two general types of perforating tools. First, it is known to use ignitable charges, such as a gun that fires a bullet propelled by an explosive propellant. The gun is lowered into the vicinity of the casing that is desired to be perforated and, upon actuation of the gun from an above-ground control signal, the bullet is fired and caused to penetrate the well casing and adjacent cement and bore formation. This type of perforating device may also utilize chemical charges, such as thermite or the like, disposed adjacent the inner wall of the well casing so that the desired perforation can be formed by igniting the charge which burns through the casing wall. Devices of this type utilizing an explosive or ignitable composition are basically unreliable in actual operation because of variations in charge compositions and the unpredictable manner in which bullets penetrate the casing and associated formation material. The use of bullets is particularly critical since the explosive impact sometimes causes unexpected damage to the well assembly that is always extremely expensive to repair.

The second type of perforating tool taught by the prior art comprise motor-driven mechanical drills which are normally housed within enclosures that are supported by a cable and lowered into the well casing to the desired location. A basic design problem inherent in tools of this type is the manner in which the dual functions of rotating the drill bit, and advancing and retracting the drill bit with respect to the interior wall of the casing, are effected. Typically, the tool is lowered and locked into position within the well casing and a second cable supporting the motor and associated drill bit is lowered and raised to move the bit towards and away from the casing wall. The drill bit is normally supported at the end of a flexible drill shaft cable that extends from the drive shaft of the motor and bends laterally in a direction towards the interior wall surface of the casing. This basic structure is also found in similar tools utilized for drilling and removing samples from well bore formations.

SUMMARY OF THE INVENTION

It is an object of the invention to provide an improved perforating tool which reliably perforates a well casing at any location along the length of the casing.

It is another object of the invention to provide an improved perforating tool which quickly and easily perforates well casings made from any material without damaging the well assembly.

It is yet another object of the invention to provide an improved perforating tool which is capable of effecting accurately placed single or simultaneous multiple perforations at any location along the depth of a well casing.

It is still yet another object of the invention to provide an improved well perforating tool which is simple in construction and economical to manufacture.

It is yet still a further object of the present invention to provide an improved well perforating tool which is capable of perforating well casings of different diameters.

These and other objects of the present invention are achieved by providing a well perforating tool which includes an elongate housing that is detachably supported by a cable for raising and lowering the tool within the well casing. A first motor disposed within the housing serves to rotate a flexible drill shaft provided with a free end for connection to an appropriate drill bit. The flexible drill shaft is disposed within a guide that directs the bit laterally towards the interior wall surface of the well casing. A second motor disposed within the housing is operatively connected to the first motor for moving the latter back and forth along the longitudinal axis of the housing so that the drill bit may be advanced and retracted with respect to the well casing. The lower end of the housing is provided with a detachable boot having a diameter that corresponds substantially to but is less than that of the well casing to be perforated so that the tool is automatically centralized within the casing, with the retracted drill bit being disposed directly adjacent the portion of the casing to be perforated. A potentiometer having an extensible indicator connected to the first motor is also disposed within the tool housing for monitoring the drilling operation so that the depth of the perforation being produced can be determined. The two motors and potentiometer are in electrical communication with a ground level control panel through power supply and signal cables associated with the tool support cable.

Other objects and aspects of the invention and the various features of construction will become apparent to those skilled in this art upon reference to the following specification and the accompanying drawings forming a part hereof.

DETAILED DESCRIPTION OF THE INVENTION

Figure 1:
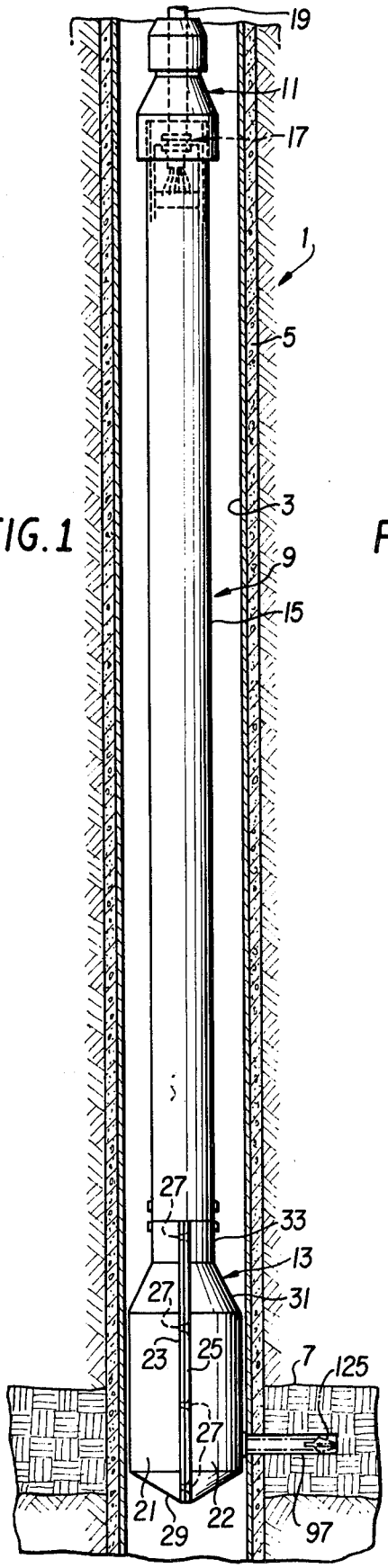
FIG. 1 is an elevational view of the well perforating tool of the present invention.

A vertical bore hole formation is generally indicated at 1 in FIG. 1 and includes a well casing 3 disposed and sealed therein by means of a cement wall 5 disposed in the annular space therebetween. Formation 1 is depicted as including a substrata layer 7 providing favorable geological conditions for extracting hydrocarbon values, such as oil or gas.

A perforating tool 9, according to the invention, is shown disposed within casing 3 and provided with a cap 11 at its upper end and a detachable boot 13 at its lower end. The main body of tool 9 is defined by an elongate housing 15 having a substantially cylindrical outer configuration. Boot 13 also preferably has a generally cylindrical outer configuration. As is apparent from FIG. 1, the diameter of housing 15 is substantially smaller than that of casing 3 in order to facilitate the insertion of tool 9 therein. However, boot 13 has a maximum diameter which substantially corresponds to and is slightly smaller than that of casing 3 so that boot 13 functions to coaxially orient tool 9 within casing 3. In this manner, tool 9 may always be centralized within well casings of different diameters merely by selecting a boot 13 having a corresponding diameter for attachment to the lower end of housing 15.

As further seen in FIG. 1, cap 11 encloses a connector 17 disposed between tool 9 and a cable assembly 19, the latter including a cable for supporting the entire weight of tool 9 and cables for transmitting electrical energy and signals between ground level and the interior components contained within housing 15. Connector 17 may comprise any such type of detachable plug, screw or interlock mechanism well known in the art and deemed suitable for the purpose of this invention. An important function of connector 17 being that substantially the entire weight of tool 9 is supported thereat through cable 19. Cap 11 may also be detachably affixed to the upper end of housing 15 by means of a threaded engagement, lock screws or any other similar well known attachment mechanism.

Boot 13 is depicted in FIG. 1 as including two substantially semi-cylindrical half shells 21 and 22 which are secured together along a pair of corresponding peripheral flanges 23 and 25 by means of a plurality of screws 27. Boot 13 is provided with a conical-shaped lower end 29 for facilitating insertion of tool 9 into casing 3. Boot 13 further includes a tapered upper portion 31 which terminates in an upper end 33 that substantially corresponds to the outer surface diameter and configuration of housing 15.

Figure 2:
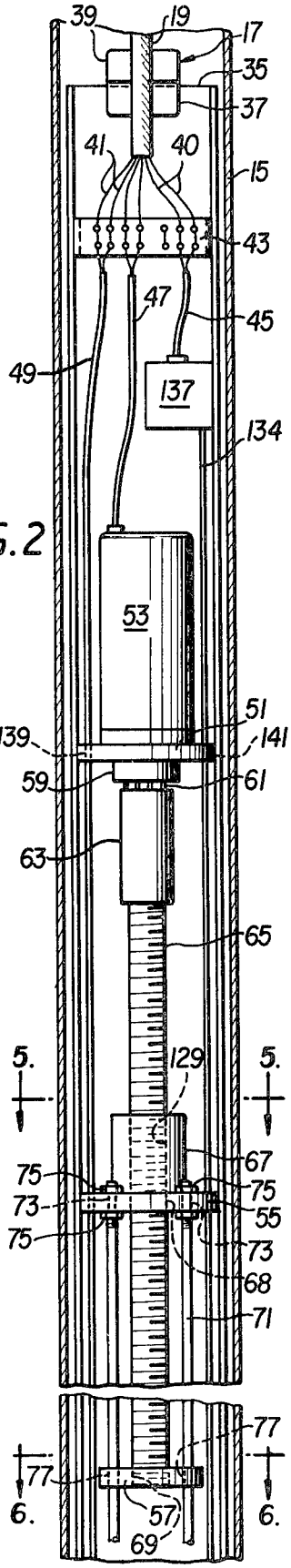
FIGS. 2, 3 and 4, when viewed together, comprise an enlarged fragmentary vertical sectional view of the well perforation tool of FIG. 1.
Figure 3:
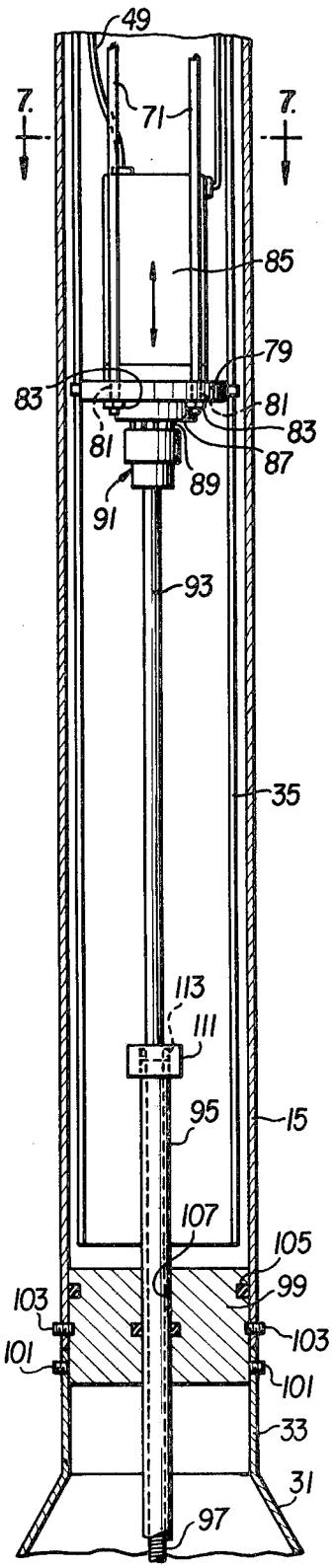

Referring now to FIGS. 2 and 3, housing 15 is shown provided with an internal component support 35 which is preferably of a semi-cylindrical configuration and may be either permanently or detachably secured to the internal wall surface of housing 15 through welding, bolting or the like. Support 35 carries a lower half 37 of connector 17. A corresponding upper half 39 of connector 17 is securely attached to cable assembly 19. All electrical and mechanical support connections between cable assembly 19 and tool 9 are achieved through the interconnection of connector halves 37 and 39.

A plurality of electrical signal lines 40 and power supply lines 41 extend from the lowermost free end of cable 19 for connection to a terminal block 43 that is also carried by support 35. Block 43 provides connections for transmission of electrical signals between lines 40 to a control line 45 and transmission of electrical energy between lines 41 and a plurality of control lines 47 and 49. The ultimate control of electrical components contained within tool 9 may be achieved through a master control panel disposed on ground level and provided with known electrical and electronic devices for varying and maintaining the transmission of electrical energy and signals through lines 40 and 41 and monitoring the operation of the individual components being controlled through lines 45, 47 and 49. Such known devices may include voltmeters for providing an indication of voltage being utilized, variacs for controlling the amount of current distributed, digital displays for indicating depth of perforating or drilling, and the like.

Support 35 includes a first fixed plate 51 for supporting a drive motor 53. A first movable plate 55 is disposed below plate 51 for movement back and forth along the longitudinal axis of support 35. A second fixed plate 57 is carried by support 35 and disposed below plate 55. A lock disc 59 is provided for securing motor 53 to plate 51, preferably through a threaded connection. A splined drive shaft 61 extends downwardly from motor 53 through plate 51 and disc 59 for connection to one end of a coupling 63, the latter being preferably flexible in nature. The other end of coupling 63 is attached to one end of a threaded drive shaft 65 for transmitting rotary action imparted by shaft 61. Shaft 65 is passed through a bearing cage 67 carried by plate 55 and also through a correspondingly threaded aperture 68 in plate 55. The end of shaft 65 is journaled for free rotation through an unthreaded guide aperture 69 provided in plate 57.

A plurality of guide rods 71 are disposed with one set of adjacent ends being threaded and secured to plate 55 through apertures 73 by means of a plurality of nuts 75. Rods 71 pass downwardly through a plurality of apertures 77 in plate 57. The other adjacent ends of rods 71 are also threaded and terminate in their connection to a second movable plate 79. This is achieved by passing the ends of rods 71 through apertures 81 provided in plate 79 and attaching the ends thereto by means of a plurality of nuts 83.

A drill motor 85 is supported on plate 79 by a lock disc 87, preferably through a threaded connection. A splined drive shaft 89 extends downwardly from motor 85 through plate 79 and disc 87 for connection to a collar 91 for transmitting the rotary motion of shaft 89 to a rigid drill shaft 93 carried at the lower end of collar 91. The free end of shaft 93 is passed into a tubular shaft guide 95 for connection to a flexible drill shaft 97, with shafts 93 and 97 being freely rotatable within guide 95.

As shown in FIG. 3, a sealing plug 99 is disposed within the lower end of housing 15, with a portion thereof extending away from the end edge of housing 15. This free portion of plug 99 is embraced by upper end 33 of boot 13 which is secured thereto by a plurality of screws 101. Plug 99 may be made from any material deemed suitable for preventing fluid leakage through the end of housing 15 and is attached thereto by a plurality of screws 103. A ring gasket 105 may be disposed within plug 99 to bear against the internal surface of housing 15 as an additional precaution against well fluids from entering upwardly into housing 15. Guide 95 is disposed through a passageway 107 formed in plug 99 and sealed therein by means of a fluid tight ring gasket 109. The end of guide 95 disposed within the interior of housing 15 is threaded and sealed by a correspondingly threaded cap 111 having an internal compression gasket 113 disposed therein for bearing against the upper edge of guide 95 and adjacent circumferential surface of shaft 93. In this manner, fluids passing upwardly through the annular space defined by the interior surface of guide 95 and exterior surfaces of shafts 93 and 97 are prevented from flowing into housing 15. The sealing function of cap 111 and gasket 113 does not impair the free rotational movement of shaft 93 disposed therethrough.

Figure 4:
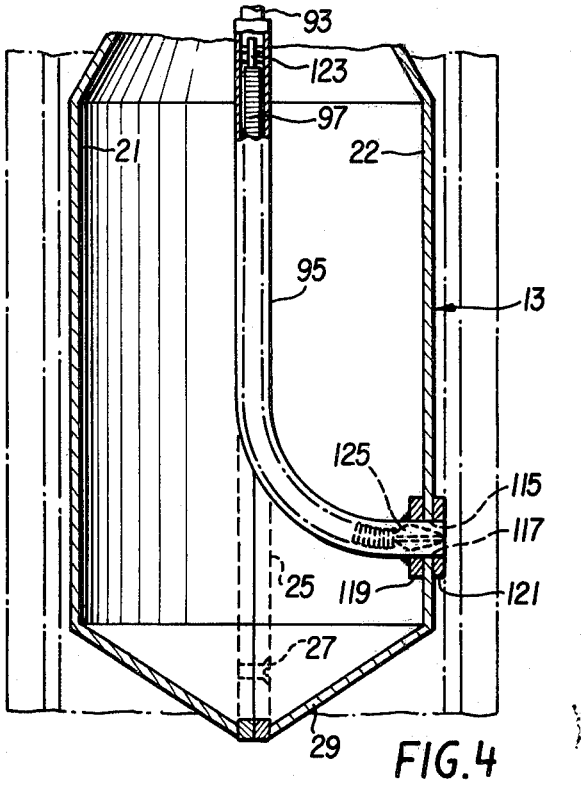

As shown in FIG. 4, guide 95 extends downwardly into boot 13 and curves laterally away from the longitudinal axis thereof, terminating in a threaded end portion 115 that passes through a correspondingly shaped aperture 117 formed in shell half 22 of boot 13. End 115 is rigidly secured within aperture 117 by a pair of opposed nuts 119 and 121. The end of rigid drive shaft 93 is detachably connected to the upper end of flexible drive shaft 97 through an interlock 123 which may include a pin, set screw or any other expedient well known in the art for accomplishing this function and permitting joint rotative action of shafts 93 and 97. The free end of flexible drill shaft 97 is provided with an appropriate detachable drill bit 125, the shape and nature of which are well known in the art and may be selected for the physical characteristics required to accomplish any given perforating operation.

Figure 5:
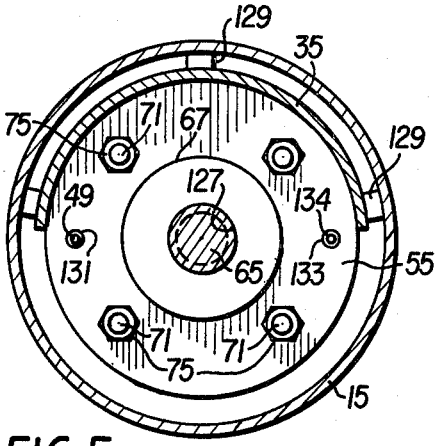
FIG. 5 is an enlarged horizontal sectional view, taken along the line 5—5 of FIG. 2.
Figure 7:
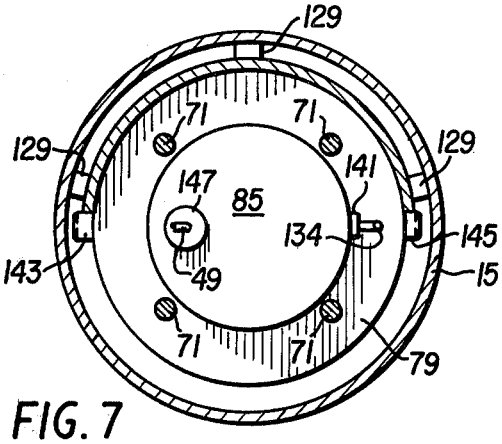
FIG. 7 is an enlarged horizontal sectional view, taken along the lines 7—7 of FIG. 3.
Figure 6:
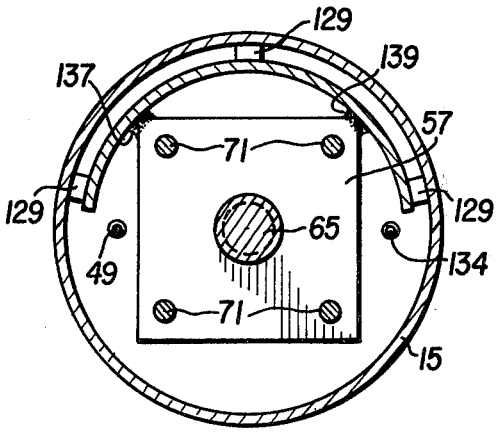
FIG. 6 is an enlarged horizontal sectional view, taken along the line 6—6 of FIG. 2.

The orientation of plates 55, 57 and 79 with respect to support member 35, threaded shaft 65 and rods 71 is more clearly depicted in FIGS. 5, 6 and 7. As shown therein, plate 55 is substantially of a flat ring having a central opening 68, as shown in FIG. 2, that is coextensive with a central passageway 127 in bearing cage 67 through which shaft 65 is passed. The peripheral curvature of plate 55 corresponds substantially to the inner curvature of support 35, with plate 55 being movable along the longitudinal axis of support 35. The outer surface of support 35 is spaced from the inner surface of housing 15 and is permanently or detachably secured thereto through a plurality of struts 129. Plate 55 also includes an aperture 131 through which control line 49 is passed for ultimate connection to drill motor 85. Plate 55 further includes a second aperture 133 through which an indicating member 134, such as a spring or the like, may be passed. Member 134 extends downwardly from a perforating depth monitoring device 137, as shown in FIG. 2, such as a potentiometer or other well known device of this nature. Device 137 is carried by support 35 with member 134 being extensible and retractable with respect thereto. Plate 51 is also provided with a pair of apertures 127 and 129 therethrough for passage of line 45 and member 134, respectively. Plate 51 is rigidly secured to support 35 through welding or the like.

Plate 57, as shown in FIG. 6, may be substantially square in configuration and is secured to support 35 by welding a pair of adjacent corners thereto as indicated at 137 and 139. As further shown, additional struts 129 may be provided adjacent plate 57 for securing support 35 to housing 15 through welding, bolting or the like.

Referring to FIG. 7, plate 79 is shown as a ring-shaped disc which supports drill motor 85. Member 134 from device 137 is attached to drill motor 85 through a mechanical connection 141. Plate 79 includes a pair of opposed tabs 143 and 145 which support plate 79 for sliding movement along the longitudinal edges of support 35. Actuation of motor 85 is achieved from current supplied through line 49 which is attached to motor 85 through electrical connection 147.

Figure 8:
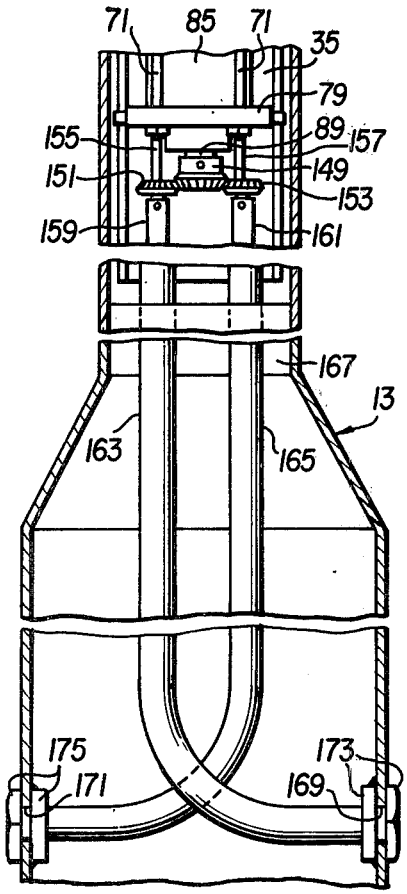
FIG. 8 is a fragmentary vertical sectional view, similar to FIG. 4, but showing a modification of the invention for providing simultaneous multiple perforations in a well casing.

FIG. 8 depicts a modification of the invention wherein two opposed holes may be simultaneously drilled. In this embodiment, drill motor 85 is provided with a primary gear 149 attached to the end of splined drive shaft 89. A pair of secondary gears 151 and 153 are rotatably secured to a pair of extensions 155 and 157 carried by plate 79 and are disposed against the toothed periphery of gear 149 in intermeshed engagement therewith. Gears 151 and 153 are drivingly connected to a pair of rigid drill shafts 159 and 161, the latter being disposed in a pair of corresponding guides 163 and 165. A plug 167 is disposed between housing 15 and boot 13, the latter having a pair of opposed openings 169 and 171 to accommodate the respective ends of guides 163 and 165. A double pair of nuts 173 and 175 secure the ends of guides 163 and 165 in their corresponding openings 169 and 171, respectively. As is apparent, rotation of primary gear 149 will cause secondary gears 151 and 153 to correspondingly rotate and thereby transmit such action through rigid shafts 159 and 161 to a pair of corresponding flexible drill shafts (not shown) rotatably connected to shafts 159 and 161 and disposed within guides 163 and 165.

Both drive motor 53 and drill motor 85 are preferably electric motors which may be any type well known in the art and suitable for performing the functions required by the operation of tool 9. Such motors should be capable of variable speed control and reversible operation. For example, a suitable motor may be a 150 volt DC reversible motor having an operational range of 400 to 9000 RPM.

MODE OF OPERATION

The manner in which tool 9 of the present invention is utilized in perforating a well casing 3 shall now be described with particular reference to FIGS. 1–4 of the drawings. At ground level, support cable 19 is first mechanically and electrically interlocked with tool 9 through connector 17 and cap 11 is placed over the corresponding end of housing 15. Flexible drill shaft 97 is attached to rigid drill shaft 93 through interlock 123 and guide 95 is slipped into place through plug 99. Cap 11 is then threadedly screwed onto the internal end of guide 95 to prevent entry of fluids into housing 15.

A boot 13 having an operative diameter correlating with that of well casing 3 is selected for assembly onto the other end of housing 15. Shell half 22 of boot 13 is first interfitted with the lower most end of guide 95 and the latter is secured in place through aperture 117 by tightening nuts 119 and 121. Shell half 21 of boot 13 is then secured against shell half 22 with screws 27. Boot 13 is then rigidly secured to plug 99 through screws 101. A suitable drill bit 125 is attached to the free end of flexible drill shaft 97, with the working end of drill bit 125 being disposed within and substantially flush with the outer surface of shell half 22.

Tool 9 is then lowered into well casing 3 through cable 19 to the desired perforating depth. During this procedure, boot 13 serves to centralize the descent of tool 9 so that its longitudinal axis is essentially coaxial with that of well casing 3. When tool 9 has arrived at the predetermined depth, for example, at a favorable geological substrata 7, it is seen that the disposition of boot 13 places open end of drill bit 125 directly adjacent the portion of well casing 3 to be perforated. In this manner, the time consuming and unreliable procedures for centralizing tools of this type are thereby eliminated and highly accurate perforating is possible through the use of the present invention by direct location and centralization of tool 9 in well casing 3.

The actual perforating of well casing 3 is initiated by directing current to drill motor 85 through control line 49 so that rotation of splined drive shaft 89 causes rigid shaft 93, flexible drill shaft 97 and drill bit 125 to correspondingly rotate in the same manner. The speed of drill bit rotation can be controlled by varying the amount of current being supplied to drill motor 85 from ground level. Advancing of drill bit 125 towards well casing 3 is achieved by supplying current to drive motor 53 through control line 47. This causes rotation of splined drive shaft 61, which in turn transmits rotary action to threaded drive shaft 65 through coupling 63. Assuming drive shaft 65 is provided with right hand threading, then counterclockwise rotation of shaft 65 within bearing cage 67 causes plate 55 to move away from motor 53. This in turn causes drill motor 85 to also move downwardly with plate 79, the latter sliding along the open longitudinal edges of support 35 through tabs 143 and 145. The resulting corresponding downward movement of rigid drill shaft 93 advances flexible drill shaft 97 and its associated bit 125 into and through well casing 3. Continued advancing of drill bit 125 in this manner causes it to penetrate the adjacent cement 5 and substrata material 7, thereby permitting the hydrocarbon values contained within the latter to enter the interior of well casing 3.

The degree in which drill bit 125 perforates and enters into substrata 7 is accurately determined through device 137, which is preferably a potentiometer, and associated indicating member 134. Since the latter is connected to drill motor 85, advancement of motor 85 during the perforating procedure pulls member 134 downwardly, with the degree of downward movement being electrically sensed through lines 40 and 41 at ground level. When the desired degree of perforating has been accomplished, drive motor 53 is reversed in operation, thereby causing a clockwise rotation of threaded shaft 65 which in turn pulls plate 55 towards drive motor 53. Drill bit 125 is then retracted from the drilled hole and back into boot 13. Tool 9 may then be either rotated, raised or lowered to other desired positions within casing 3 for perforating additional holes therethrough.

With particular reference to FIG. 8, it is seen that by utilizing double pairs of rigid and flexible drill shafts, multiple perforations may be achieved simultaneously with tool 9 in the same basic manner as described for a single perforating operation.

It is to be understood that the forms of the invention herein shown and described are to be taken as preferred examples of the same, and that various changes in shape, size and arrangement of parts may be resorted to without departing from the spirit of the invention or scope of the subjoined claims.

What is claimed is:

1. A well perforating tool comprising:
(a) an elongate housing for insertion into the well,
(b) at least one flexible drill shaft having a free end for connection to a drill bit,
(c) a first motor disposed within and movable relative to the housing for rotating the flexible drill shaft, and
(d) a second motor carried by the housing and operatively connected to the first motor for moving the latter along the longitudinal axis of the housing to advance and retract the flexible drill shaft with respect to the interior wall of the well.

2. The tool of claim 1 further including:
(a) a plug having a passageway therethrough for sealing an end of the housing, and
(b) guide means disposed within the passageway for directing the flexible drill shaft towards the interior wall of the well.

3. The tool of claim 1 wherein the operative connection between the first and second motors includes:
(a) a threaded shaft carried and rotated by the second motor, and
(b) at least one rod having one end carried by the threaded shaft and the other end carried by the first motor.

4. The tool of claim 1 further including means for ascertaining the degree of flexible drill shaft advance during perforating.

5. The tool of claim 1 further including means for centralizing the longitudinal axis of the tool within the well.

6. The tool of claim 5 wherein the centralizing means includes a hollow boot detachably carried by an end of the housing and having a substantially cylindrical outer configuration.

7. The tool of claim 5 wherein the centralizing means includes an opening through which the flexible drill shaft is advanced and retracted.

8. A well perforating tool comprising:
(a) an elongate housing for insertion into the well;
(b) at least one flexible drill shaft having a free end for connection to a drill bit;
(c) a first motor movably disposed within the housing for rotating the flexible drill shaft;
(d) a second motor operatively connected to the first motor for moving the latter along the longitudinal axis of the housing to advance and retract the flexible drill shaft with respect to the interior wall of the well; and
(e) wherein the first and second motors are operatively connected by:
1. a threaded shaft,
2. a flexible coupling connecting the threaded shaft to the second motor, and
3. at least one rod having a first end carried by the threaded shaft and a second end carried by the first motor.

9. A well perforating tool comprising:
(a) an elongate housing for insertion into the well;
(b) at least one flexible drill shaft having a free end for connection to a drill bit;
(c) a first motor movably disposed within the housing for rotating the flexible drill shaft;
(d) a second motor operatively connected to the first motor for moving the latter along the longitudinal axis of the housing to advance and retract the flexible drill shaft with respect to the interior wall of the well; and
(e) wherein the first and second motors are operatively connected by:

1. a threaded shaft carried and rotated by the second motor,
2. a first plate carried by the threaded shaft for movement along the length thereof in response to the rotation of the threaded shaft,
3. a second plate supporting the first motor, and
4. at least one rod having a first end connected to the first plate and a second end connected to the second plate.

10. The tool of claim 9 further including:
(a) an elongate member disposed within the housing,
(b) a third plate carried by the elongate member for supporting the second motor, and
(c) a fourth plate carried by the elongate member through which the threaded shaft and rod are slidably journaled.

* * * * *